US009825367B2

(12) United States Patent
Gong et al.

(10) Patent No.: US 9,825,367 B2
(45) Date of Patent: Nov. 21, 2017

(54) DIPOLE ANTENNA AND WIRELESS TERMINAL DEVICE

(71) Applicant: Huawei Device Co., Ltd., Shenzhen (CN)

(72) Inventors: Yiwen Gong, Wuhan (CN); Kemeng Wang, Wuhan (CN); Yunpeng Shen, Wuhan (CN); Yuhui Wang, Wuhan (CN); Dejin Zhu, Wuhan (CN)

(73) Assignee: HUAWEI DEVICE CO., LTD., Shenzhen (CN)

( * ) Notice: Subject to any disclaimer, the term of this patent is extended or adjusted under 35 U.S.C. 154(b) by 610 days.

(21) Appl. No.: 14/472,638

(22) Filed: Aug. 29, 2014

(65) Prior Publication Data

US 2015/0116176 A1 Apr. 30, 2015

(51) Int. Cl.

| | |
|---|---|
| ***H01Q 9/16*** | (2006.01) |
| ***H01Q 9/18*** | (2006.01) |
| ***H01Q 1/24*** | (2006.01) |
| *H01Q 1/38* | (2006.01) |

(52) U.S. Cl.

CPC ..... *H01Q 9/18* (2013.01); *H01Q 1/243* (2013.01); *H01Q 9/16* (2013.01); *H01Q 1/38* (2013.01)

(58) Field of Classification Search

CPC H01Q 9/18; H01Q 1/243; H01Q 9/16; H01Q 1/38

USPC ..... 343/821

See application file for complete search history.

(56) References Cited

U.S. PATENT DOCUMENTS

| | | | | |
|---|---|---|---|---|
| 4,495,505 | A | 1/1985 | Shields | |
| 5,532,708 | A * | 7/1996 | Krenz | H01Q 9/40 343/795 |
| 2005/0110698 | A1 | 5/2005 | Surducan et al. | |
| 2006/0033666 | A1 | 2/2006 | Su et al. | |

FOREIGN PATENT DOCUMENTS

| | | | |
|---|---|---|---|
| CN | 1734836 | A | 2/2006 |
| CN | 1825704 | A | 8/2006 |
| CN | 2901604 | Y | 5/2007 |
| CN | 201163660 | Y | 12/2008 |
| CN | 101849318 | A | 9/2010 |
| CN | 202013937 | U | 10/2011 |

(Continued)

OTHER PUBLICATIONS

Partial English Translation and Abstract of Chinese Patent Application No. CN2901604, Jul. 7, 2016, 4 pages.

(Continued)

*Primary Examiner* — Graham Smith

(74) *Attorney, Agent, or Firm* — Conley Rose, P.C.

(57) ABSTRACT

Embodiments of the present invention disclose a dipole antenna and a wireless terminal device, which relate to communications technologies and enable an antenna to have a relatively high performance and a relatively low production cost. The dipole antenna includes a first radiation arm, a second radiation arm, and a balun. The first radiation arm and the second radiation arm are both soldered on a dielectric substrate. The first radiation arm and the second radiation arm are separately connected to the balun electrically. The balun is electrically connected to a feeding point and a reference ground separately. The present invention may be applied to a terminal device.

19 Claims, 5 Drawing Sheets

(56) References Cited

FOREIGN PATENT DOCUMENTS

| | | | |
|---|---|---|---|
| CN | 102629708 | A | 8/2012 |
| CN | 102800965 | A | 11/2012 |
| CN | 203026637 | U | 6/2013 |
| CN | 103337712 | A | 10/2013 |
| WO | 2009030041 | A1 | 3/2009 |

OTHER PUBLICATIONS

Foreign Communication From a Counterpart Application, Chinese Application No. 201380003754.6, Chinese Office Action dated May 25, 2016, 9 pages.
Partial English Translation and Abstract of Chinese Patent Application No. CN1825704A, Part 1, May 4, 2015, 3 pages.
Partial English Translation and Abstract of Chinese Patent Application No. CN1825704A, Part 2, May 4, 2015, 2 pages.
Partial English Translation and Abstract of Chinese Patent Application No. CN201163660Y, Part 1, May 14, 2015, 3 pages.
Partial English Translation and Abstract of Chinese Patent Application No. CN201163660Y, Part 2, May 14, 2015, 2 pages.
Chuang, H., et al., "3-D FDTD Design Analysis of a 2.4-GHz Polarization-Diversity Printed Dipole Antenna With Integrated Balun and Polarization-Switching Circuit for WLAN and Wireless Communication Applications," IEEE Transactions on Microwave Theory and Techniques, vol. 51, No. 2, Feb. 2003, pp. 374-381.
Foreign Communication From a Counterpart Application, European Application No. 13876087.1, Extended European Search Report dated Apr. 28, 2015, 8 pages.
Foreign Communication From a Counterpart Application, Chinese Application No. 201380003754.6, Chinese Office Action dated Jan. 20, 2017, 9 pages.
Partial English Translation and Abstract of Chinese Patent Application No. CN202013937U, Nov. 25, 2014, 7 pages.
Partial English Translation and Abstract of Chinese Patent Application No. CN102629708A, Sep. 15, 2014, 21 pages.
Foreign Communication From a Counterpart Application, PCT Application No. PCT/CN2013/086335, International Search Report dated Jun. 30, 2014, 7 pages.
Foreign Communication From a Counterpart Application, PCT Application No. PCT/CN2013086335, Written Opinion dated Jul. 8, 2014, 5 pages.

* cited by examiner

DIPOLE ANTENNA AND WIRELESS TERMINAL DEVICE

CROSS-REFERENCE TO RELATED APPLICATION

This application is a continuation of International Application PCT/CN2013/086335, filed on Oct. 31, 2013, which is hereby incorporated by reference in its entirety.

TECHNICAL FIELD

The present invention relates to communications technologies, and in particular, to a dipole antenna and a wireless terminal device having the dipole antenna.

BACKGROUND

With rapid development of wireless terminal products (such as mobile phones, computers, tablet computers, gateways, routers, and set top boxes), competition among manufacturers grows more and more fierce. To better meet market requirements, terminal products need to retain high-end and stable performance as well as low costs so that comprehensive competitiveness of products can be improved.

At present, there are multiple types of antennas, such as an external antenna, a built-in bracket antenna, and a printed circuit board (PCB) antenna, commonly used by the wireless terminal products. The external antenna is superior in performance, but is every expensive and unfavorable to fine industry design (ID). The built-in antenna is favorable to fine ID and relatively superior in performance; however, such an antenna needs to be fastened to an extra bracket, and a bracket antenna is generally formed by hot melting a steel sheet on a plastic bracket, leading to a relatively high production cost. The PCB antenna is not only favorable to fine ID, but also of a relatively low production cost; however, its antenna radiation pattern is easily affected by a current on the PCB, resulting in general performance (inferior to the performance of the foregoing two types of antennas). It can be seen from the foregoing description that the commonly used forms of antennas at present cannot have the features of high performance and low costs simultaneously.

SUMMARY

Embodiments of the present invention provide a dipole antenna and a wireless terminal device, which can enable an antenna to have relatively high performance and a relatively low production cost.

To achieve the foregoing purposes, the embodiments of the present invention use the following technical solutions.

According to a first aspect, an embodiment of the present invention provides a dipole antenna including a first radiation arm, a second radiation arm, and a balun. The first radiation arm and the second radiation arm are both soldered on a dielectric substrate, the first radiation arm and the second radiation arm are separately connected to the balun electrically, and the balun is electrically connected to a feeding point and a reference ground separately.

With reference to the first aspect, in a first possible implementation manner, the balun is disposed on the dielectric substrate.

With reference to the first possible implementation manner, in a second possible implementation manner, the balun is connected to the feeding point by using a microstrip feeding conductor, and the microstrip feeding conductor and the balun are disposed oppositely and distributed on different surfaces of the dielectric substrate.

With reference to the second possible implementation manner, in a third possible implementation manner, a lower end of the first radiation arm is disposed with a first pin, the first pin is soldered on the dielectric substrate, a lower end of the second radiation arm is disposed with a second pin, and the second pin is soldered on the dielectric substrate.

With reference to the third possible implementation manner, in a fourth possible implementation manner, the dielectric substrate is provided with a first through hole and a second through hole, where the first pin extends out of the first through hole and is fastened to the dielectric substrate by soldering, and the second pin extends out of the second through hole and is fastened to the dielectric substrate by soldering.

With reference to the first aspect, or any one of the first to fourth possible implementation manners, in a fifth possible implementation manner, the lower end of the first radiation arm and the lower end of the second radiation arm are separately connected to the balun electrically.

With reference to the third or fourth possible implementation manner, in a sixth possible implementation manner, the balun includes a first conductor and a second conductor. The first conductor has one end connected to the lower end of the first radiation arm and the other end connected to the reference ground. The second conductor has one end connected to the lower end of the second radiation arm and the other end connected to the reference ground.

With reference to the sixth possible implementation manner, in a seventh possible implementation manner, the microstrip feeding conductor includes a first feeding conductor. The first feeding conductor is in parallel with and opposite to the first conductor. The first feeding conductor has one end connected to the feeding point and the other end electrically connected to the second pin.

With reference to the seventh possible implementation manner, in an eighth possible implementation manner, the microstrip feeding conductor further includes a second feeding conductor. One end of the second feeding conductor is connected to one end of the first feeding conductor far away from the feeding point and the other end of the second feeding conductor is connected to the second pin.

With reference to the eighth possible implementation manner, in a ninth possible implementation manner, a figure of the first conductor and a figure of the first feeding conductor correspond to each other.

With reference to the ninth possible implementation manner, in a tenth possible implementation manner, the second feeding conductor is located between the first pin and the second pin.

With reference to any one of the sixth to tenth possible implementation manners, in an eleventh possible implementation manner, the balun further includes a third conductor. The third conductor is connected between one end of the first conductor close to the reference ground and one end of the second conductor close to the reference ground. The third conductor is electrically connected to the reference ground.

With reference to the eleventh possible implementation manner, in a twelfth possible implementation manner, the third conductor is disposed with a third pin. The third pin is soldered on the dielectric substrate.

With reference to the eleventh possible implementation manner, in a thirteenth possible implementation manner, a sum of lengths of the first conductor, the second conductor, and the third conductor is a quarter of an electromagnetic wavelength. The electromagnetic wavelength is an electromagnetic wavelength of a resonance frequency of the dipole antenna.

With reference to any one of the sixth to tenth possible implementation manners, in a fourteenth possible implementation manner, the first conductor and the second conductor are disposed independently of each other on the dielectric substrate.

With reference to the fourteenth possible implementation manners, in a fifteenth possible implementation manner, one end of each of the first conductor and the second conductor close to the reference ground is disposed with a third pin. The third pin is soldered on the dielectric substrate and is electrically connected to the reference ground.

With reference to the twelfth or fifteenth possible implementation manner, in a sixteenth possible implementation manner, the dielectric substrate is provided with a third through hole. The third pin extends out of the third through hole and is fastened to the dielectric substrate by soldering.

With reference to the fourteenth possible implementation manner, in a seventeenth possible implementation manner, a sum of a length of the first conductor, a length of the second conductor, and a distance between a ground end of the first conductor and a ground end of the second conductor is a quarter of an electromagnetic wavelength. The electromagnetic wavelength is an electromagnetic wavelength of a resonance frequency of the dipole antenna.

With reference to the first aspect and any one of the first to seventeenth possible implementation manners, in an eighteenth possible implementation manner, the dielectric substrate is a PCB.

With reference to the eighteenth possible implementation manner, in a nineteenth possible implementation manner, the PCB is provided with a clearance area. The clearance area is disposed with the first radiation arm, the second radiation arm, and the balun. The feeding point and the reference ground are disposed in an area outside the clearance area on the PCB.

With reference to any one of the eleventh to thirteenth possible implementation manners, in a twentieth possible implementation manner, the first radiation arm, the second radiation arm, the first conductor, the second conductor, and the third conductor are integrally formed.

With reference to any one of the eleventh to thirteenth possible implementation manners, in a twenty-first possible implementation manner, the first conductor, the second conductor, and the third conductor are printed on the dielectric substrate.

With reference to any one of the eleventh to thirteenth possible implementation manners, in a twenty-second possible implementation manner, the first conductor, the second conductor, and the third conductor are in regular shapes or irregular shapes.

With reference to any one of the fourteenth to seventeenth possible implementation manners, in a twenty-third possible implementation manner, the first radiation arm and the first conductor are integrally formed, and the second radiation arm and the second conductor are integrally formed.

With reference to any one of the fourteenth to seventeenth possible implementation manners, in a twenty-fourth possible implementation manner, the first conductor and the second conductor are printed on the dielectric substrate.

With reference to any one of the fourteenth to seventeenth possible implementation manners, in a twenty-fifth possible implementation manner, the first conductor and the second conductor are in regular shapes or irregular shapes.

With reference to any one of the foregoing possible implementation manners, in a twenty-sixth possible implementation manner, the first radiation arm and the second radiation arm are in regular shapes or irregular shapes.

According to a second aspect, an embodiment of the present invention further provides a wireless terminal device including the dipole antenna in any one of the foregoing possible implementation manners. The wireless terminal further includes a radio frequency circuit, a processing circuit, and a storage circuit. The dipole antenna is connected to the radio frequency circuit, the radio frequency circuit is connected to the processing circuit, and the processing circuit performs a communications function or data processing by running a software program and a module that are stored in the storage circuit.

The dipole antenna and the wireless terminal device provided in the embodiments of the present invention include a first radiation arm, a second radiation arm, and a balun. The first radiation arm and the second radiation arm are both soldered on a dielectric substrate so that the first radiation arm and the second radiation arm can be automatically assembled to the dielectric substrate by using a machine instead of being formed on a plastic bracket by means of hot melting a steel sheet, thereby implementing low cost production. After the first radiation arm and the second radiation arm are fastened to the dielectric substrate, the first radiation arm and the second radiation arm are separately connected to the balun electrically, and the balun is electrically connected to a feeding point and a reference ground separately so as to implement balanced feeding for the first radiation arm and the second radiation arm, reduce a current flowing to the reference ground, and further reduce an effect on an antenna radiation pattern, thereby enabling the antenna to have relatively high performance.

BRIEF DESCRIPTION OF DRAWINGS

To describe the technical solutions in the embodiments of the present invention more clearly, the following briefly introduces the accompanying drawings required for describing the embodiments or the prior art. The accompanying drawings in the following description show merely some embodiments of the present invention, and a person of ordinary skill in the art may still derive other drawings from these accompanying drawings without creative efforts.

REFERENCE NUMERALS

1—first radiation arm, 10—first pin, 2—second radiation arm, 20—second pin, 3—balun, 30, 60—first conductor, 31, 61—second conductor, 32—third conductor, 320—third pin, 4—dielectric substrate (PCB board), 40—non-copper-clad area (clearance area), 41—copper-clad area, 5—microstrip feeding conductor, 50—first feeding conductor, 51—second feeding conductor

DESCRIPTION OF EMBODIMENTS

The following clearly describes the technical solutions in the embodiments of the present invention with reference to the accompanying drawings in the embodiments of the present invention. The described embodiments are merely a part rather than all of the embodiments of the present invention. All other embodiments obtained by a person of ordinary skill in the art based on the embodiments of the present invention without creative efforts shall fall within the protection scope of the present invention.

A dipole antenna provided in the embodiments of the present invention may be applied to different wireless terminal devices. As described in above, a built-in antenna is favorable to ID design of a terminal device. Based on this, the present invention provides a dipole antenna that is low cost and high performance.

Figure 1:
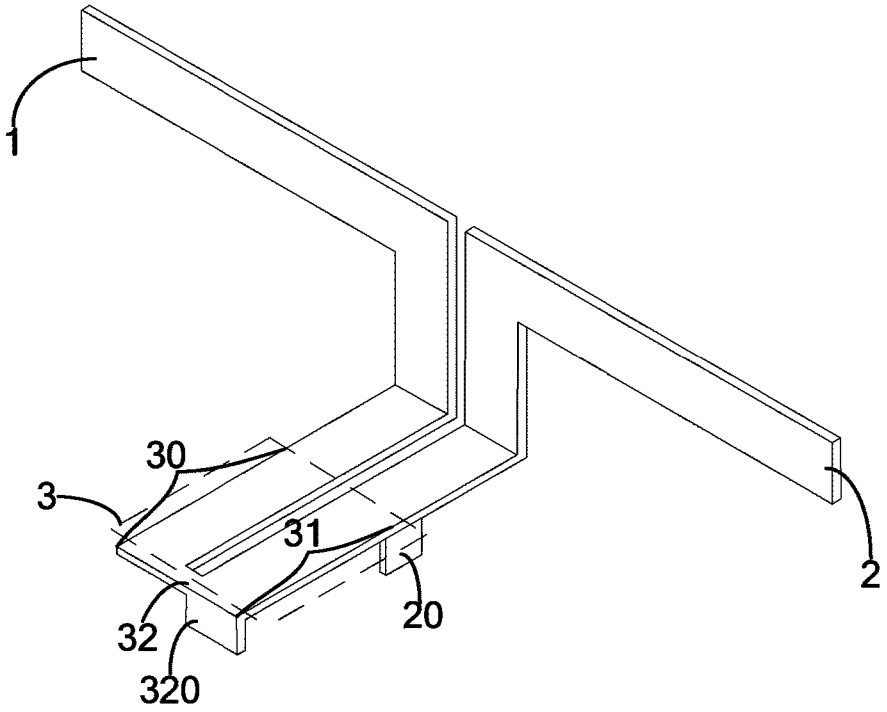
FIG. 1 is a schematic front view of a dipole antenna according to Embodiment 1 of the present invention.
Figure 3:
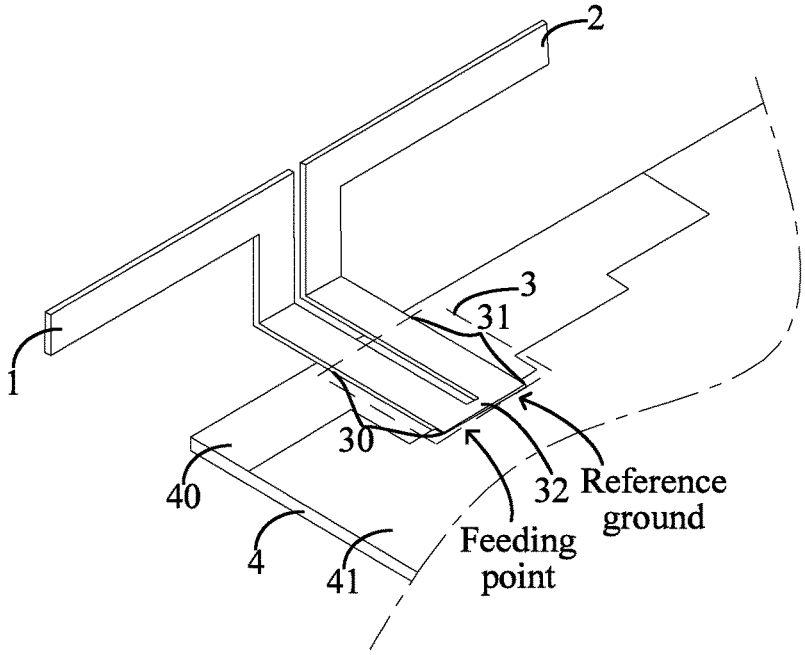
FIG. 3 is a schematic front view of a dipole antenna soldered on a dielectric substrate according to Embodiment 1 of the present invention.

The embodiments of the present invention provide a dipole antenna, for which, reference may be made to FIG. 1 and FIG. 3. The dipole antenna may include a first radiation arm 1, a second radiation arm 2, and a balun 3. The first radiation arm 1 and the second radiation arm 2 are both soldered on a dielectric substrate 4. The first radiation arm 1 and the second radiation arm 2 are separately connected to the balun 3 electrically, and the balun 3 is electrically connected to a feeding point and a reference ground separately.

The first radiation arm 1 and the second radiation arm 2 are soldered on the dielectric substrate 4 so that the first radiation arm 1 and the second radiation arm 2 can be automatically assembled to the dielectric substrate 4 by using a machine instead of being formed on a plastic bracket by means of hot melting a steel sheet, thereby implementing low cost production. After the first radiation arm 1 and the second radiation arm 2 are fastened to the dielectric substrate 4, the first radiation arm 1 and the second radiation arm 2 are separately connected to the balun 3 electrically, and the balun 3 is electrically connected to a feeding point and a reference ground so as to implement balanced feeding for the first radiation arm 1 and the second radiation arm 2, reduce a current flowing to the reference ground, and further reduce an effect on an antenna radiation pattern, thereby enabling the antenna to have relatively high performance.

The balun is a balanced-unbalanced transformer. The English word balun is a contraction of the two words "balanced" and "unbalanced," where balance represents a balance signal while unbalance represents an unbalanced signal. A balun circuit can perform mutual conversion between a differential signal and a single-end signal to ensure a current symmetry of the dipole antenna.

The dielectric substrate 4 may be a printed circuit board (PCB) or an insulation substrate made of another material. The dielectric substrate 4 is further made of a different material according to a magnitude of a resonance frequency required by the dipole antenna.

The dipole antenna provided in the embodiments of the present invention may be applied to wireless terminal devices. Development of wireless terminal devices, however, is promoted towards structure miniaturization nowadays. Therefore, the dielectric substrate 4 mentioned herein is preferably a PCB. Referring to FIG. 3, a copper-clad area 41 is provided on a surface of the PCB. A person skilled in the art may know that when an antenna is disposed in the copper-clad area, performance of the antenna is affected. Therefore, a non-copper-clad area 40 is further provided in an area on the PCB board close to the antenna. That is, a clearance area is formed so as to avoid an effect on the performance of the antenna. In this case, the clearance area may be disposed with the first radiation arm 1, the second radiation arm 2, and the balun 3, and the feeding point and the reference ground are disposed in an area (namely the copper-clad area 41) outside the clearance area on the PCB board. The balun 3 may also not be disposed on the PCB. The present invention uses an exemplary embodiment in which the balun 3 is disposed on the PCB. In this way, the balun 3 is integrated on the PCB, which can save inner space of the terminal device and is favorable to structure miniaturization of the terminal device.

It should be noted that the dielectric substrate 4 mentioned below refers to a PCB, which is merely used as an exemplary solution of the embodiments of the present invention. The embodiments of the present invention are not limited thereto.

Based on the foregoing content, the dipole antenna provided in the embodiments of the present invention is described below in detail.

Embodiment 1

Figure 2:
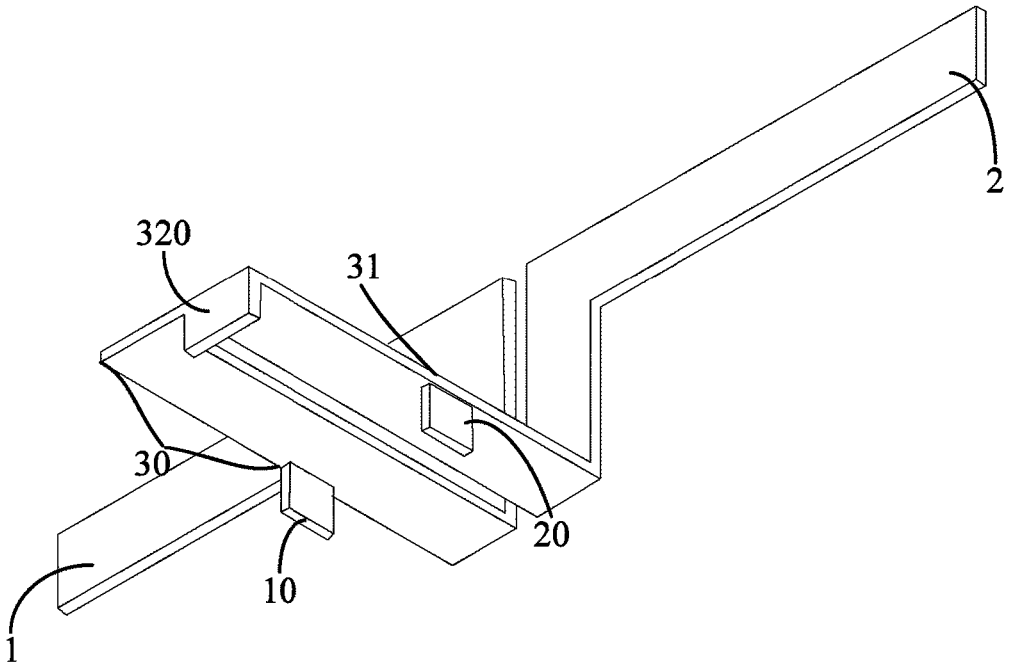
FIG. 2 is a schematic rear view of a dipole antenna according to Embodiment 1 of the present invention.

As shown in FIG. 1 and FIG. 2, a dipole antenna includes a first radiation arm 1, a second radiation arm 2, and a balun 3. A lower end of the first radiation arm 1 may be disposed with a first pin 10, a lower end of the second radiation arm 2 may be disposed with a second pin 20, and a non-copper-clad area 40 of a dielectric substrate 4 may be disposed with a first pad and a second pad as shown in FIG. 3. By using an automatic assembly means such as wave soldering, the first pin 10 may be soldered on the first pad (not shown in the figures) and the second pin 20 may be soldered on the second pad (not shown in the figures) so that the first radiation arm 1 and the second radiation arm 2 are fastened to the dielectric substrate 4 by soldering. It should be noted that pads may take two forms in terms of functions. In one form, a pad may be used for surface-mounting an element, and in the other form, a pad may be used for inserting an element. Optionally, in the present invention, the latter pad form is used. That is, the first pin 10 and the second pin 20 are both fastened to the dielectric substrate 4 by means of element insertion. Specifically, the dielectric substrate 4 is disposed with a first through hole (not shown in the figures) and a second through hole (not shown in the figures) where the first pin 10 extends out of the first through hole and is fastened to the dielectric substrate 4 by soldering and the second pin 20 extends out of the second through hole and is fastened to the dielectric substrate 4 by soldering.

After the first radiation arm 1 and the second radiation arm 2 are fastened to the dielectric substrate 4, the two are separately connected to the balun 3 electrically and the balun 3 is electrically connected to a feeding point and a reference ground separately. By using features of the balun 3, balanced feeding is implemented for the first radiation arm 1 and the second radiation arm 2, a current flowing to the reference ground is reduced, and an antenna radiation pattern is made symmetrical or substantially symmetrical, thereby improving performance of the antenna.

Figure 4:
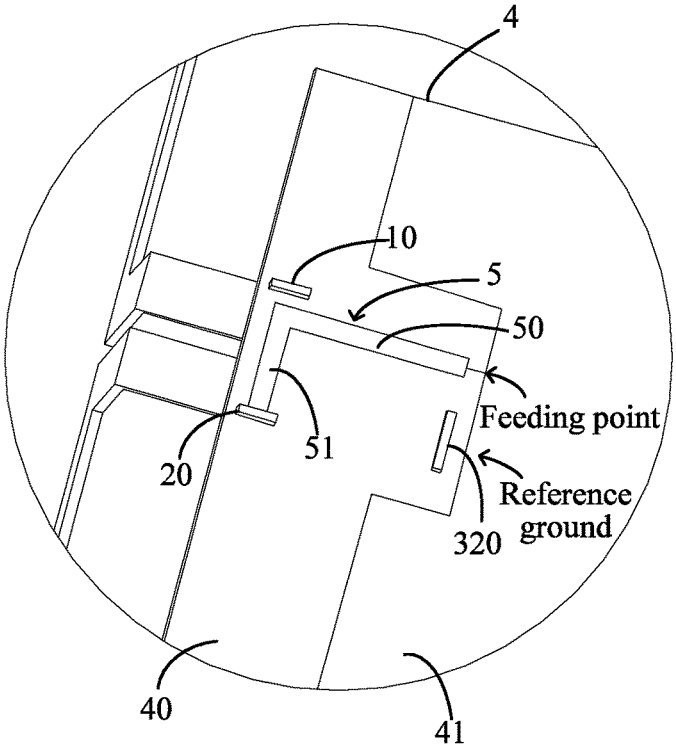
FIG. 4 is a schematic rear view of a dipole antenna soldered on a dielectric substrate according to Embodiment 1 of the present invention.

For a feeding manner of the dipole antenna, a manner of a coaxial cable (cable) feeding may be used. However, a manner of connecting the coaxial cable and the antenna involves manual soldering, which makes overall costs relatively high. In view of this, in the present invention, a microstrip feeding manner is used. Specifically, as shown in FIG. 4, a microstrip feeding conductor 5 is printed on the dielectric substrate 4, and the microstrip feeding conductor 5 is electrically connected to a feeding point of the balun 3. The microstrip feeding conductor 5 and the balun 3 are disposed oppositely and are distributed on different surfaces of the dielectric substrate 4 (herein, for ease of understanding, a surface disposed with the balun 3 of the dielectric substrate 4 is referred to as a front surface, and a surface disposed with the microstrip feeding conductor is referred to as a rear surface).

A person skilled in the art may know that a balun generally has two feeding points. In this specification, when the lower end of the first radiation arm 1 and the lower end of the second radiation arm 2 are separately connected to an end portion of the balun 3 directly, the first pin 10 may form one of the feeding points of the balun 3, and the second pin 20 forms the other feeding point of the balun 3. The microstrip feeding conductor is electrically connected to the balun 3, and the feeding points of the balun 3 may be formed by the first pin 10 and the second pin 20. Therefore, after being inserted into the dielectric substrate 4, the first radiation arm 1 and the second radiation arm 2 can be electrically connected to the microstrip feeding conductor to avoid using a cable so that manual soldering is not required and the costs are further reduced.

Referring to FIG. 1 to FIG. 3, a structure of the balun 3 may include a first conductor 30, a second conductor 31, and a third conductor 32. The first conductor 30 has one end connected to the lower end of the first radiation arm 1 (or the first pad on the dielectric substrate 4) and the other end close to the reference ground. The second conductor 31 has one end connected to the lower end of the second radiation arm 2 (or the second pad on the dielectric substrate 4) and the other end close to the reference ground. The third conductor 32 is connected between the end of the first conductor 30 close to the reference ground and the end of the second conductor 31 close to the reference ground. The third conductor 32 is electrically connected to the reference ground.

The first conductor 30, the second conductor 31, and the third conductor 32 are an integrally formed balun structure, which may be a component mounted to the dielectric substrate 4, the same as the first radiation arm 1 and the second radiation arm 2. In this case, the third conductor 32 may be disposed with a third pin 320. The third pin 320 is soldered on the dielectric substrate 4 and is connected to the reference ground. The third conductor 32 may form an integrally formed structure with the first radiation arm 1 and the second radiation arm 2. As shown in FIG. 4, the third conductor 32 may also be disposed with the third pin 320. The third pin 320 is soldered on the dielectric substrate 4 and is connected to the reference ground.

A manner of soldering the third pin 320 on the dielectric substrate 4 is similar to that for the first pin 10 and the second pin 20 described above, in which the dielectric substrate 4 is provided with a third through hole (not shown in the figures) and the third pin 320 extends out of the third through hole and is fastened to the dielectric substrate 4 by soldering.

The foregoing integrally formed balun structure may be microstrips printed on the dielectric substrate 4. In this case, compared with an integrally formed structure of the balun structure and the first radiation arm 1 and the second radiation arm 2, metal materials of the balun 3 can be reduced, thereby further reducing the costs and improving product competitiveness.

Referring to FIG. 4, a structure of the microstrip feeding conductor 5 may include a first feeding conductor 50 printed on the dielectric substrate 4. The first feeding conductor 50 has one end connected to the feeding point marked in FIG. 4 and the other end electrically connected to the second pin 20 of the second radiation arm 2 so that the first feeding conductor 50 is electrically connected to a second feeding point (the second pin 20). The first feeding conductor 50 is in parallel with and opposite to the first conductor 30. In this way, coupling is generated between the first feeding conductor 50 and the first conductor 30 so that the first feeding conductor 50 forms a coupled electrical connection and a dual-feeding structure with a first feeding point (the first pin 10).

Figures of the first conductor 30 and the first feeding conductor 50 correspond to each other, and lengths of the first conductor 30 and the first feeding conductor 50 are the same. That is, projections of the first conductor 30 and the first feeding conductor 50 on the dielectric substrate 4 completely overlap each other. In this way, the first conductor 30 and the first feeding conductor 50 may be coupled to generate a current having a same magnitude, but an opposite direction, relative to a current generated in the first feeding conductor 50. The second conductor 31 generates a current having a same magnitude and a same direction as a current generated in the first feeding conductor 50 so that currents of the first pin 10 and the second pin 20 have a same magnitude but are in opposite directions, thereby implementing balanced feeding for the first radiation arm 1 and the second radiation arm 2.

To better implement balanced feeding for the first radiation arm 1 and the second radiation arm 2, a total length of a groove (a current loop from the first pin 10 to the second pin 20) of the balun 3 is a quarter of an electromagnetic wavelength of a resonance frequency of the dipole antenna. In an embodiment, the length of the groove of the balun 3 equals or substantially equals a sum of lengths of the first conductor 30, the second conductor 31, and the third conductor 32. This can further reduce a current flowing to the reference ground on the dielectric substrate 4 and an effect of the reference ground on an antenna radiation pattern, thereby improving performance of the antenna.

The first conductor 30, the second conductor 31, and the third conductor 32 may be in the shape of rectangles as shown in the figures or in other regular shapes not shown in the figures, such as a regular curved shape and arc shape. The first conductor 30, the second conductor 31, and the third conductor 32 may also be in irregular odd-form shapes as long as the length of the groove of the formed balun 3 is a quarter of the electromagnetic wavelength of the resonance frequency of the dipole antenna.

The microstrip feeding conductor may further include a second feeding conductor 51 printed on the dielectric substrate 4. As shown in FIG. 4, one end of the second feeding conductor 51 is connected to one end of the first feeding conductor 50 close to the first pin 10, and the other end of the second feeding conductor 51 is connected to the second pin 20 that extends out of a surface of the dielectric substrate 4 (or may be connected to the second pad on the dielectric substrate 4) so as to implement electrical connection between the microstrip feeding conductor and the second pin 20.

In order not to generate a coupling effect between the second feeding conductor 51 and the second conductor 31, the second feeding conductor 51 is disposed between the first pin 10 and the second pin 20. A figure of the second feeding conductor 51 is not limited to a straight-line shape shown in the figures, and may also be a regular or irregular shape such as a curved shape or an arc shape as long as the coupling effect is not generated between the second feeding conductor 51 and the second conductor 31.

In addition, the first radiation arm 1 and the second radiation arm 2 may be of a mutually symmetrical structure shown in the figures, and both are in regular curved shapes or in other regular shapes or irregular shapes not shown in the figures. The first radiation arm 1 and the second radiation arm 2 may also not be of a mutually symmetrical structure, and both may also be in regular shapes or irregular shapes as long as frequencies of the first radiation arm 1 and the second radiation arm 2 may be modulated to the resonance frequency.

It should be noted that after the first radiation arm 1 and the second radiation arm 2 are soldered on the dielectric substrate 4, a part of each radiation arm falls on the front surface of the dielectric substrate 4, and the remaining part extends out of an edge of the dielectric substrate 4 to form a state shown in FIG. 3 or FIG. 4. In this way, on the one hand, the first radiation arm 1 and the second radiation arm 2 are kept far away from the copper-clad area of the dielectric substrate 4, thereby reducing the effect on the performance of the antenna. On the other hand, the antenna can further occupy a relatively small area of the dielectric substrate 4, thereby miniaturizing the dielectric substrate 4 and further miniaturizing a structure of a terminal device.

The part of each radiation arm extending out of the dielectric substrate 4 may be substantially located on a same horizontal plane with the front surface of the dielectric substrate 4, or may be bent to form a certain angle with the front surface of the dielectric substrate 4. A case in which the angle is ninety degrees (90°) may be used as an exemplary solution of the present invention. In this case, not only can the antenna occupy a relatively small area of the dielectric substrate 4, but also space between the front surface of the dielectric substrate 4 and a housing of the terminal device can be effectively used so that a structure of the terminal device is more compact.

Embodiment 2

Figure 5:
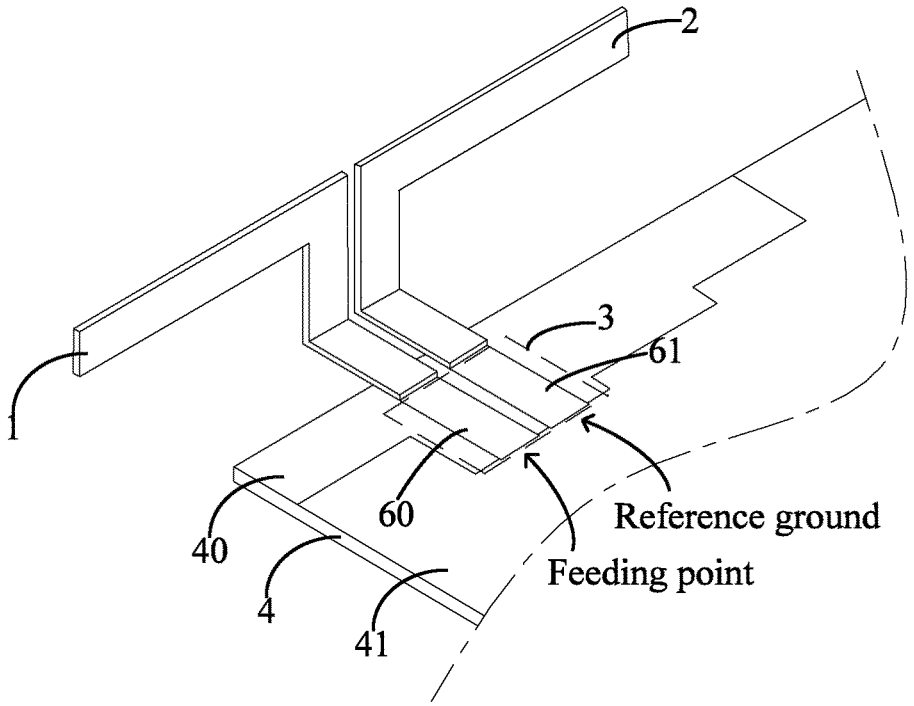
FIG. 5 is a schematic front view of a dipole antenna soldered on a dielectric substrate according to Embodiment 2 of the present invention.

Compared with Embodiment 1, a difference of this embodiment lies in that a first conductor 60 and a second conductor 61 are disposed independently of each other on a dielectric substrate 4 as shown in FIG. 5. That is, a balun 3 includes the first conductor 60 and the second conductor 61. The first conductor 60 has one end connected to a lower end of a first radiation arm 1 (or a first pad on the dielectric substrate 4), and the other end directly connected to a reference ground marked in FIG. 5. The second conductor 61 has one end connected to a lower end of a second radiation arm 2 (or a second pad on the dielectric substrate 4), and the other end directly connected to the reference ground.

The first conductor 60 and the second conductor 61 may both be components mounted to the dielectric substrate 4. In this case, the end of each of the first conductor 60 and the second conductor 61 close to the reference ground is disposed with a third pin (not shown in the figure). In some embodiments, the third pin is soldered on the dielectric substrate 4 and is connected to the reference ground. In some embodiments, the third pin is soldered on the first conductor 60 and the first radiation arm 1 and the second conductor 61 and the second radiation arm 2 separately form an integrally formed structure. Similarly, one end of each of the first conductor 60 and the second conductor 61 close to the reference ground is disposed with a third pin. The third pin is soldered on the dielectric substrate 4 and is connected to the reference ground.

Figure 6:
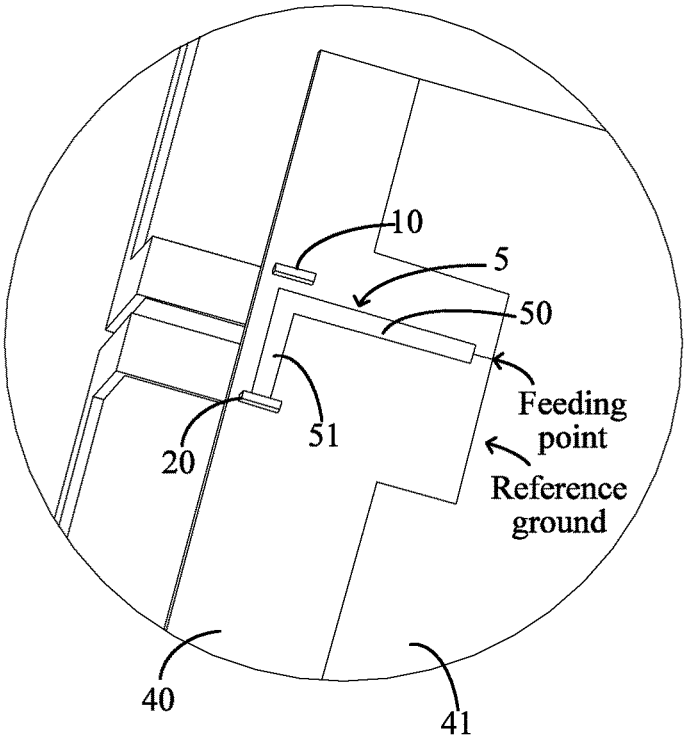
FIG. 6 is a schematic rear view of a dipole antenna soldered on a dielectric substrate according to Embodiment 2 of the present invention.

The first conductor 60 and the second conductor 61 in this embodiment may also be microstrips printed on the dielectric substrate 4. As shown in FIG. 6, a third pin is not necessarily disposed. In this way, compared with the integrally formed structure formed by each of the first conductor 60 and the first radiation arm 1, and the second conductor 61 and the second radiation arm 2, metal materials of the balun 3 can be reduced, thereby further reducing costs and improving product competitiveness.

In this embodiment, a total length of a groove (a current loop from a first pin 10 to second pin 20) of the balun 3 equals or substantially equals a sum of a length of the first conductor 60, a length of the second conductor 61, and a distance between a ground end of the first conductor 60 and a ground end of the second conductor 61. When the total length of the groove of the balun 3 is a quarter of an electromagnetic wavelength of a resonance frequency of a dipole antenna, a current flowing to the reference ground of the dielectric substrate 4 can be further reduced, thereby eliminating an effect of the reference ground on an antenna radiation pattern, and improving performance of the antenna.

The first conductor 60 and the second conductor 61 may be in shapes of rectangles shown in the figures or in other regular shapes not shown in the figures such as a regular curved shape and arc shape. The first conductor 60 and the second conductor 61 may also be in irregular odd-form shapes as long as the length of the groove of the formed balun 3 is a quarter of the electromagnetic wavelength of the resonance frequency of the dipole antenna.

Embodiment 3

A dipole antenna in the present invention may cover all frequency bands with proper size design. Herein, an antenna of each size correspondingly covers a different frequency band. This embodiment is described by using a dipole antenna covering a frequency band of 2.4 GHz (gigahertz)-2.5 GHz (gigahertz) as an example.

Figure 7:
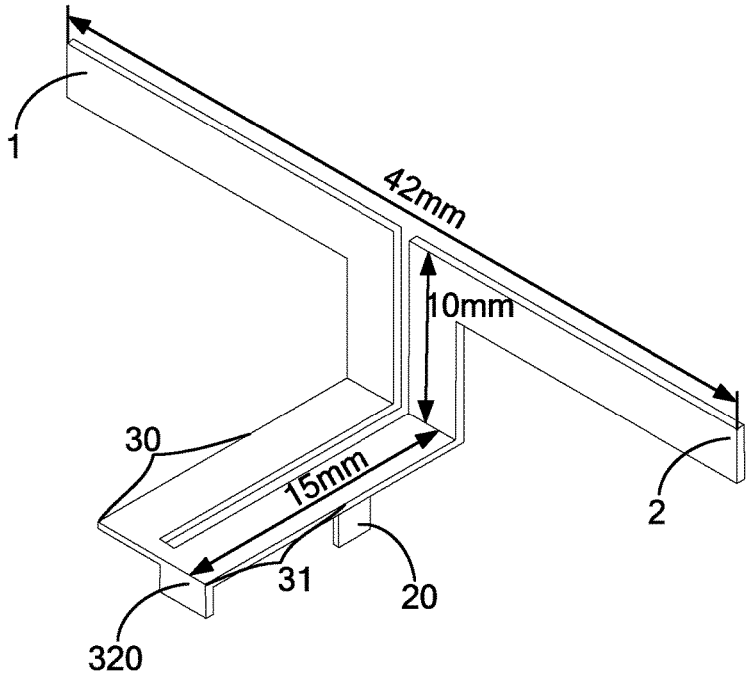
FIG. 7 is a schematic diagram of a dipole antenna according to Embodiment 3 of the present invention.

FIG. 7 shows a size of the dipole antenna, and a feeding manner thereof is as follows.

Figure 8:
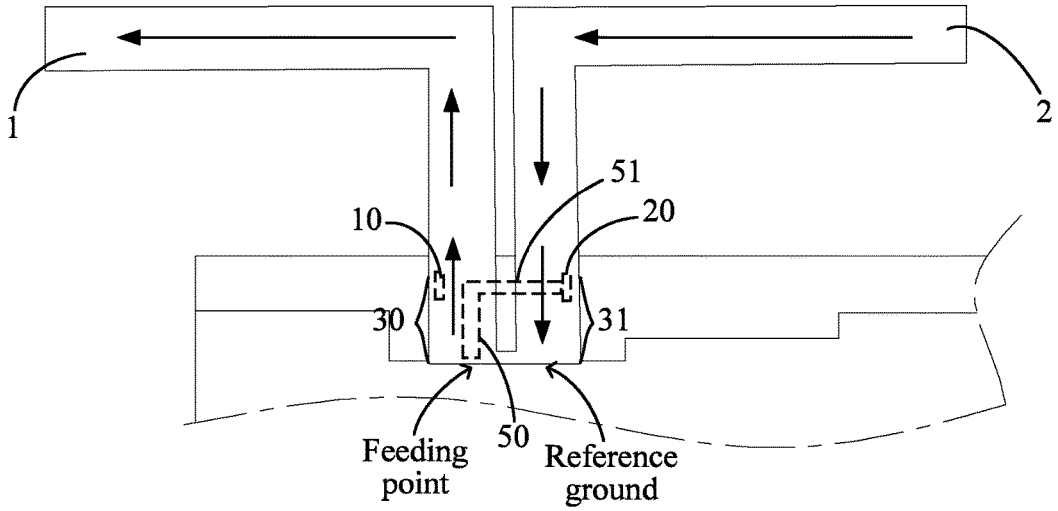
FIG. 8 is a schematic diagram of flow of a current through a dipole antenna according to Embodiment 3 of the present invention.

With reference to FIG. 3 and FIG. 4, the first conductor 30 on the front surface of the dielectric substrate 4 is coupled to the first feeding conductor 50 on the rear surface of the dielectric substrate 4 to form a dual-feeding structure. In a layout state shown in FIG. 8, when a vertically downward current is fed from a feeding point to the first feeding conductor 50, the first conductor 30 is coupled to the first feeding conductor 50 to generate a vertically upward current (like an arrow shown in FIG. 8 and indicating a vertically upward direction), which has a same or approximately same magnitude as a current of the first feeding conductor 50. In this case, a direction of a current of the first pin 10 is a direction that is perpendicular to a drawing surface shown in FIG. 8 and points inward. Meanwhile, the current of the first feeding conductor 50 is fed from the second pin 20 into the second conductor 31, and the second conductor 31 generates a vertically downward current (like an arrow shown in FIG. 8 and indicating a vertically downward direction). In this case, a direction of a current of the second pin 20 is a direction that is perpendicular to the drawing surface shown in FIG. 8 and points outward. In this way, the current of the first pin 10 (a first feeding point) and the current of the second pin 20 (a second feeding point) have a same magnitude and are in opposite directions, thereby implementing balanced feeding for the first radiation arm 1 and the second radiation arm 2.

Figure 9:
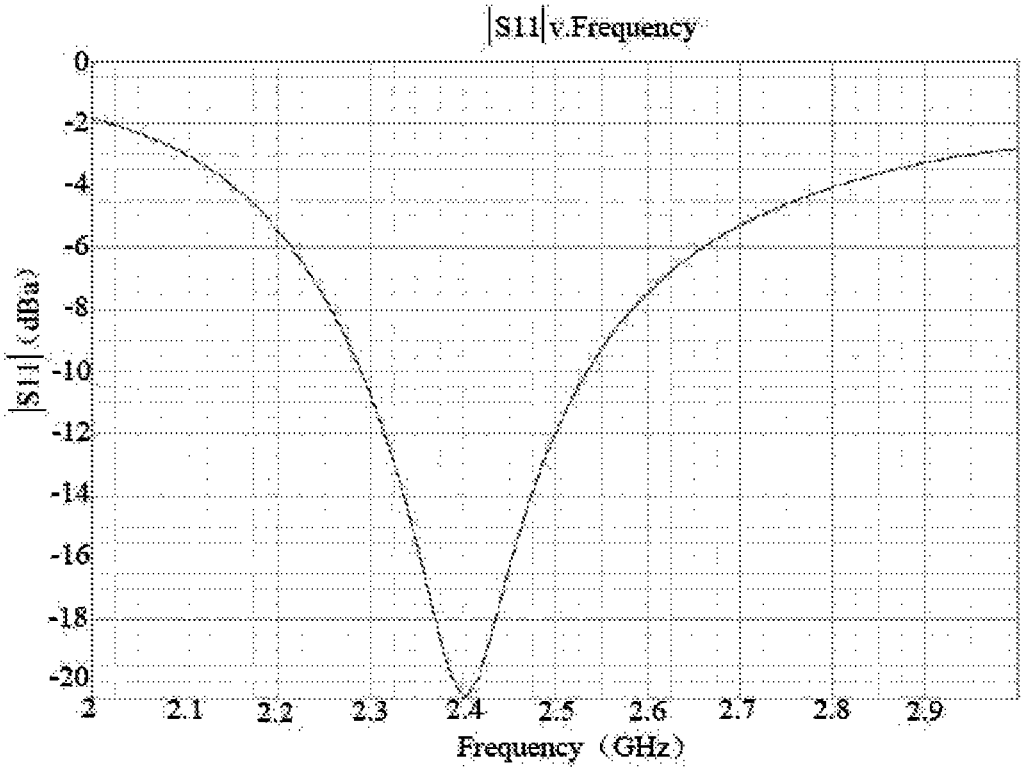
FIG. 9 is a return loss curve graph of a dipole antenna according to Embodiment 3 of the present invention.

When a current of the first conductor 30 and a current of the second conductor 31 converge at a grounding point, because a current of the first conductor 30 flowing to the grounding point and a current of the second conductor 31 flowing to the grounding point are in opposite directions, currents in the two directions basically cancel each other out. In this way, a current flowing to the reference ground is reduced and an effect of the reference ground on the antenna is further reduced, thereby enabling the dipole antenna to have relatively good directivity and relatively low energy consumption (where in a return loss graph shown in FIG. 9, in a frequency band a smaller return loss value indicates lower energy consumption of the antenna in transmission of a signal. That is, a deeper groove of a graph curve shown in FIG. 9 is better).

Table 1 shows actual testing efficiency of the dipole antenna in this embodiment. As can be seen from testing data in Table 1, the efficiency of the dipole antenna is relatively high.

TABLE 1

| Frequency (GHz) | Efficiency (%) |
|---|---|
| 2.4 | 65.7432 |
| 2.41 | 63.5906 |
| 2.42 | 66.0993 |
| 2.43 | 69.2997 |
| 2.44 | 71.6435 |
| 2.45 | 68.5866 |
| 2.46 | 66.3775 |
| 2.47 | 67.9732 |
| 2.48 | 70.8433 |
| 2.49 | 74.5151 |
| 2.5 | 73.0276 |

It should be emphasized herein that antennas of different sizes generally correspondingly cover different frequency bands. This embodiment is described by using only an antenna of one of the sizes as an example. When the antenna is of another size different from the size provided in this embodiment, the antenna covers another frequency band different from the frequency band of 2.4 GHz (gigahertz)-2.5 GHz (gigahertz). In other words, with a structure of the dipole antenna in the present invention, all frequency bands can be covered.

Embodiment 4

This embodiment further provides a wireless terminal device, including the dipole antenna in any one of the foregoing forms. Because the dipole antenna has already been described above in detail, details are not described herein again.

The foregoing wireless terminal device may be a mobile phone, a tablet computer, a gateway, a router, a set top box, a Personal Digital Assistant (PDA), a Point of Sale (POS) device, an in-vehicle computer, or the like.

Description is made by using an example in which the wireless terminal device is a mobile phone. The mobile phone includes a storage circuit, a processing circuit, a radio frequency (RF) circuit, a dipole antenna, and the like. The dipole antenna includes the first radiation arm, the second radiation arm, and the balun described above. When the mobile phone transmits a signal, a current signal is fed from a feeding point into a microstrip feeding conductor, and the microstrip feeding conductor feeds a current into the balun by using electrical coupling to the balun, thereby implementing, by using the balun, balanced feeding for the first radiation arm and the second radiation arm. A radiation arm converts the current signal into an electromagnetic signal and radiates the signal into space. When the mobile phone receives an electromagnetic signal, the electromagnetic signal is converted into a current signal by a radiation arm, and the current signal is fed from the radiation arm into the microstrip feeding conductor by the balun. The current signal input from the microstrip feeding conductor flows into the radio frequency circuit, and then flows from the radio frequency circuit to the processing circuit so that the processing circuit executes a communications standard or protocol by running a software program and a module that are stored in the storage circuit.

The foregoing executed communications standard or protocol is, for example, a Global System for Mobile Communications (GSM), a General Packet Radio Service (GPRS), a Code Division Multiple Access (CDMA), a Wideband Code Division Multiple Access (WCDMA), a Long-Term Evolution (LTE), an email, or an Short Messaging Service (SMS).

The foregoing descriptions are merely specific embodiments of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A dipole antenna, comprising:

a dielectric substrate;

a first radiation arm with a first pin disposed at a lower end of the first radiation arm, wherein the first pin is soldered onto the dielectric substrate;

a second radiation arm with a second pin disposed at a lower end of the second radiation arm, wherein the second pin is soldered onto the dielectric substrate; and a balun, wherein the balun is separately connected to each of the first radiation arm and the second radiation arm, and wherein the balun is electrically and separately connected to a feeding point and a reference ground.

2. The dipole antenna according to claim 1, wherein the balun is disposed on the dielectric substrate.

3. The dipole antenna according to claim 2, wherein the balun is connected to the feeding point using a microstrip feeding conductor, and wherein the microstrip feeding conductor and the balun are disposed oppositely and distributed on different surfaces of the dielectric substrate.

4. The dipole antenna according to claim 1, wherein the dielectric substrate comprises a first through hole and a second through hole from a top surface to an opposite surface of the dielectric substrate, and wherein the first pin traverses the first through hole and is soldered to the opposite surface of the dielectric substrate, and wherein the second pin traverses the second through hole and is soldered to the opposite surface of the dielectric substrate.

5. The dipole antenna according to claim 1, wherein each of the lower ends of the first radiation arm and the second radiation arm are separately connected to the balun electrically.

6. The dipole antenna according to claim 1, wherein the balun comprises a first conductor and a second conductor, and wherein the first conductor has one end connected to the lower end of the first radiation arm and another end connected to the reference ground, and wherein the second conductor has one end connected to the lower end of the second radiation arm and another end connected to the reference ground.

7. The dipole antenna according to claim 6, wherein the balun is connected to the feeding point using a microstrip feeding conductor, and wherein the microstrip feeding conductor comprises a first feeding conductor, and wherein the first feeding conductor is parallel with and opposite to the first conductor, and wherein the first feeding conductor has one end connected to the feeding point and another end electrically connected to the second pin.

8. The dipole antenna according to claim 7, wherein the microstrip feeding conductor further comprises a second feeding conductor, and wherein one end of the second feeding conductor is connected to one end of the first feeding conductor away from the feeding point and another end of the second feeding conductor is connected to the second pin.

9. The dipole antenna according to claim 8, wherein the first conductor and the first feeding conductor have a same dimension.

10. The dipole antenna according to claim 6, wherein the balun further comprises a third conductor, and wherein the third conductor is connected between one end of the first conductor adjacent to the reference ground and one end of the second conductor adjacent to the reference ground, and wherein the third conductor is electrically connected to the reference ground.

11. The dipole antenna according to claim 10, wherein a sum of lengths of the first conductor, the second conductor, and the third conductor is a quarter of an electromagnetic wavelength, and wherein the electromagnetic wavelength is an electromagnetic wavelength of a resonance frequency of the dipole antenna.

12. The dipole antenna according to claim 6, wherein the first conductor and the second conductor are disposed independently of each other on the dielectric substrate.

13. The dipole antenna according to claim 12, wherein one end of each of the first conductor and the second conductor adjacent the reference ground is disposed with a third pin, and wherein the third pin is soldered on the dielectric substrate and is electrically connected to the reference ground.

14. The dipole antenna according to claim 13, wherein the dielectric substrate is provided with a third through hole, and wherein the third pin extends out of the third through hole and is soldered to the dielectric substrate.

15. The dipole antenna according to claim 12, wherein a sum of a length of the first conductor, a length of the second conductor, and a distance between a ground end of the first conductor and a ground end of the second conductor is a quarter of an electromagnetic wavelength, and wherein the electromagnetic wavelength is an electromagnetic wavelength of a resonance frequency of the dipole antenna.

16. The dipole antenna according to claim 1, wherein the dielectric substrate is a printed circuit board (PCB).

17. The dipole antenna according to claim 16, wherein the PCB comprises a clearance area, and wherein the clearance area is disposed with the first radiation arm, the second radiation arm, and the balun, and wherein the feeding point and the reference ground are disposed outside the clearance area on the PCB.

18. The dipole antenna according to claim 10, wherein each of the first radiation arm, the second radiation arm, the first conductor, the second conductor, and the third conductor are integrally formed.

19. The dipole antenna according to claim 1, wherein the dipole antenna is configured to be coupled to a wireless terminal device.

* * * * *